US006089997A

United States Patent [19]

Hauptman et al.

[11] Patent Number: 6,089,997

[45] Date of Patent: Jul. 18, 2000

[54] METHOD AND APPARATUS FOR STRINGING GAME RACKET AND THE RACKET SO STRUNG

[75] Inventors: Madeline Mishel Hauptman, Scarsdale, N.Y.; David S. Luskin, Honolulu, Hi.

[73] Assignee: Triple Weave Rackets LLC, Scarsdale, N.Y.

[21] Appl. No.: 09/118,456

[22] Filed: Jul. 17, 1998

Related U.S. Application Data

[60] Provisional application No. 60/070,431, Jan. 5, 1998, provisional application No. 60/073,891, Feb. 6, 1998, and provisional application No. 60/078,981, Mar. 19, 1998.

[51] Int. Cl.[7] ..... A63B 51/00

[52] U.S. Cl. ..... 473/524; 473/543

[58] Field of Search ..... 473/524, 539, 473/540, 543

[56] References Cited

U.S. PATENT DOCUMENTS

| | | | |
|---|---|---|---|
| 3,999,756 | 12/1976 | Head . | |
| 4,184,679 | 1/1980 | Mishel . | |
| 5,443,575 | 8/1995 | Huang | 473/543 X |
| 5,478,072 | 12/1995 | Kanno et al. | 473/543 |

FOREIGN PATENT DOCUMENTS

| | | | |
|---|---|---|---|
| 2687324 | 8/1993 | France | 473/FOR 178 |
| 4-261679 | 9/1992 | Japan | 473/FOR 171 |
| 94/11064 | 5/1994 | WIPO | 473/FOR 171 |

*Primary Examiner*—Raleigh W. Chiu
*Attorney, Agent, or Firm*—Pennie & Edmonds LLP

[57] ABSTRACT

A racket and its method of manufacture which racket has three sets of string segments having particular angles among string sets and having certain stringing sequences. Strings and racket frames may be color coded and the frame may carry stringing instructions. Stringing is aided by use of a stringing clamp.

2 Claims, 7 Drawing Sheets

METHOD AND APPARATUS FOR STRINGING GAME RACKET AND THE RACKET SO STRUNG

RELATED APPLICATIONS

This application is related to U.S. Provisional Application Ser. No. 60/070,431 filed Jan. 5, 1998 entitled "Improved Method And Product For Stringing Game Racket"; U.S. Provisional Application Ser. No. 60/073,891 filed Feb. 6, 1998 entitled "Racket Frame With Improved String Support Means For Stringing Game Racket"; and U.S. Provisional Application Ser. No. 60/078,981 filed Mar. 19, 1998 entitled "Markings For String, Frame And Grommets Of Game Rackets".

BACKGROUND OF THE INVENTION

The present invention is an improvement in game rackets and their stringing and, in particular an improvement directed to the teachings of U.S. Pat. No. 4,184,679 including overcoming certain difficulties stringers found in stringing such rackets. There was resistance on the part of the stringers to learn the pattern disclosed in the '679 patent as it was found by many to be complicated to learn and too time consuming in practice. Certain tennis playing consumers, for example, did not want to buy the product disclosed in the '679 patent because it was difficult to get it restrung. Further the prior art rackets which included diagonal and horizontal string segments had the drawback that during the stringing process, when any reasonable tension was applied to the strings, distortion of the frame would occur.

Prior art three string rackets had the further complication that restringing could not in many instances be done on conventional stringing machines. Special clamps were needed to string the diagonal strings which clamps were not compatible with many stringing machines and the process of inserting verticals first took much more time than conventional stringing.

SUMMARY OF THE PRESENT INVENTION

The present inventive racket, method of stringing and stringing apparatus provide a simpler and improved system permitting racket stringing and restringing be accomplished on all stringing machines using conventional clamps or the improved clamp of the present invention. The first step in the present invention stringing method is to determine the stringing pattern having diagonal string segments and vertical or horizontal string segments. The number of string segments and the size of angles of intersection or crossovers are selected depending on the shape and size of the racket to be strung. Formulas assist in pattern formation. Once the pattern is determined holes or other string supports are located on the racket head and the racket is ready for stringing.

Stringing starts with the placing of first and second sets of opposing diagonals on or in the string supports such that the second set overlies the first diagonal set or vice versa. The stringing of the first and second diagonal sets are accomplished by alternately inserting and subsequently tensioning string segments in each direction, generally starting at the top, mid-region or bottom of the frame. When all or substantially all of the diagonal string segments have been inserted, a set of verticals (or horizontals) are then strung by weaving them over the upper diagonals and under the lower diagonals.

The angle of the diagonal string segments are selected to avoid any shortening, widening, narrowing or other distortion of the frame. The angle of the diagonals to the racket horizontal centerline and the angle of intersection of each of the diagonals is determined based on a number of factors discussed below. Preferably, diagonal segments at approximately 45° to the horizonal centerline are used; however, diagonals more or less vertical in orientation may be used provided the diagonals have the ability to counteract the horizontal forces that would otherwise warp the racket when stringing rackets in this diagonals-first method. Preferably diagonals are in the ranges of 35°–55° or 40°–50° or 43° to 47°. Algebraic formulae serve to calculate the symmetric three-directional vertical-diagonal pattern across the racket face.

Orthogonal crossing diagonals permit use of conventional swivel or floating clamps. Floating clamps may also be used on machines that do not have swivel clamps but use rail clamps for mains and floating clamps for diagonals.

The present invention also includes a method of stringing using racket and string identifications which are coordinated to assist in stringing.

Finally, the invention includes an improved clamp which is helpful in three set stringing on some machines.

DESCRIPTION OF THE PREFERRED EMBODIMENT

Figure 1:
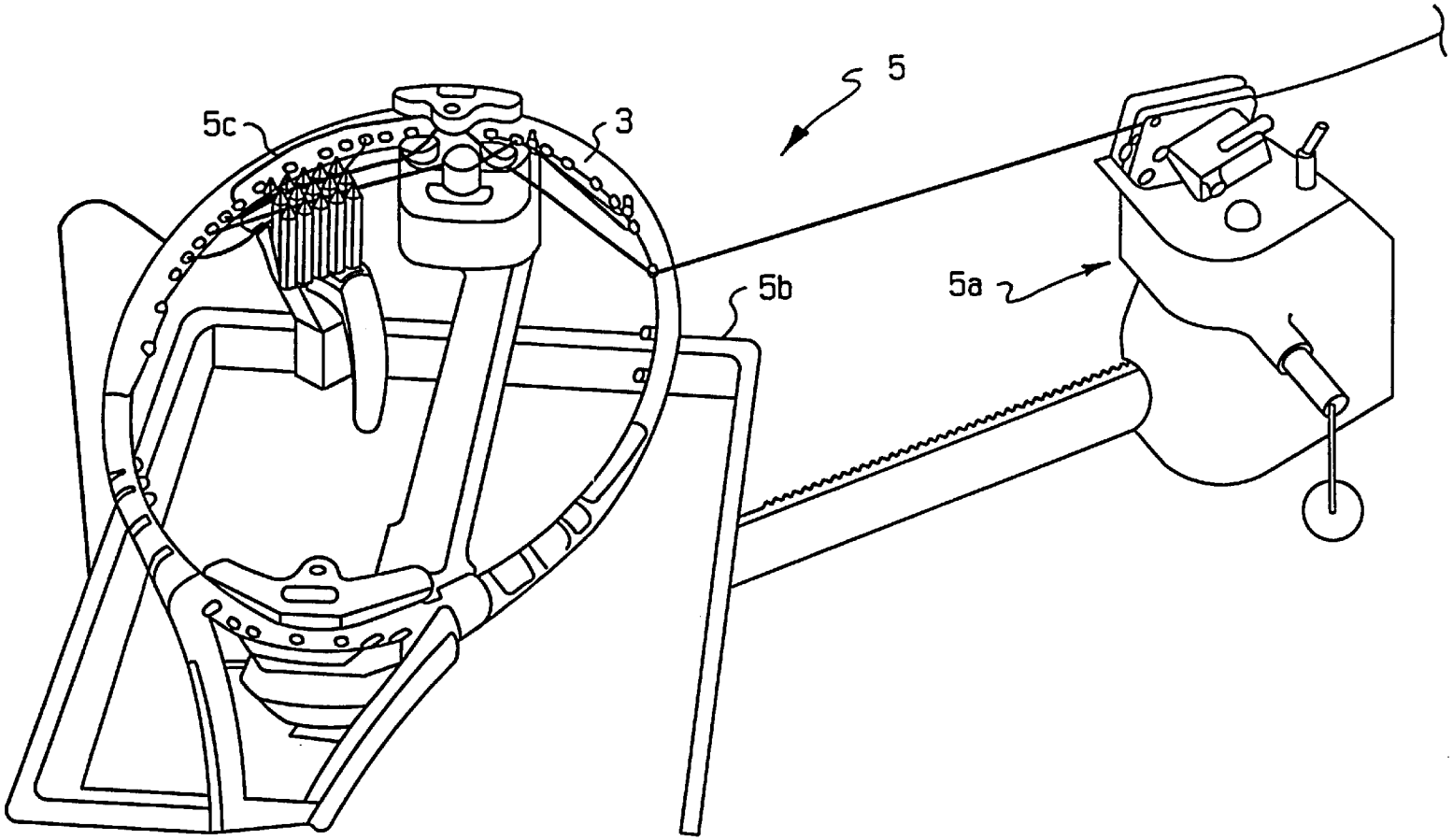
FIG. 1 is a partial perspective view of a stringing machine with a racket frame positioned for stringing.
Figure 2:
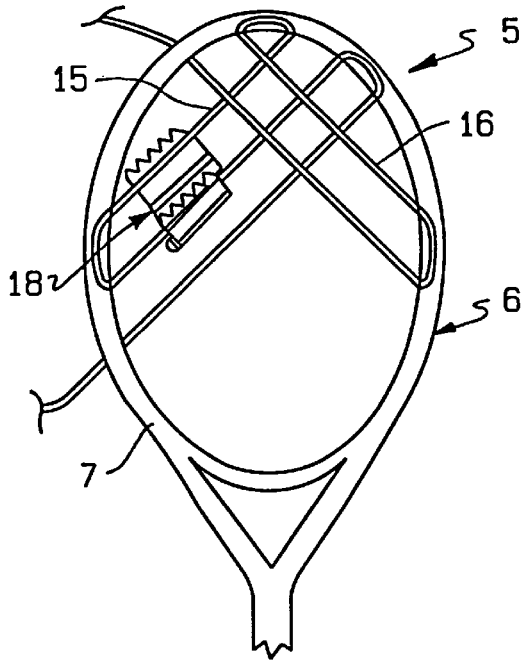
FIG. 2 is a front elevational view of the racket in the process of having its diagonals strung.

In FIG. 1 a conventional stringing machine 5 is shown for stringing a three-string racket 3 of the present invention. Also shown is stringing machine tension arm 5*a,* machine frame 5*b* and clamp 5*c.*

Figure 3:
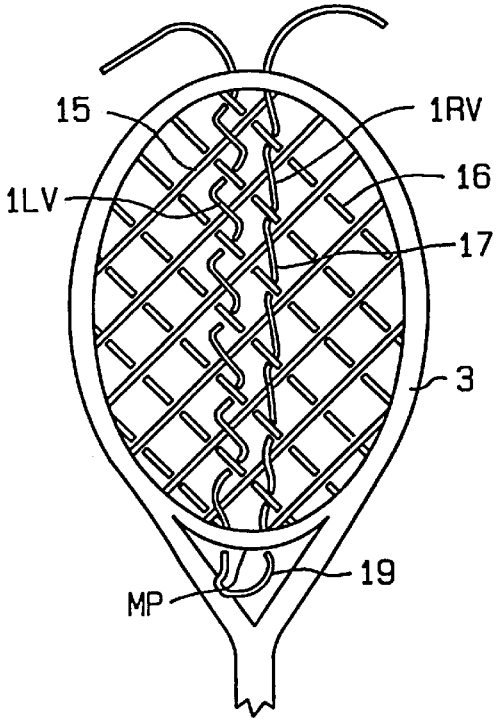
FIG. 3 is a front elevational view of the racket with its diagonals in place and vertical stringing commenced.
Figure 3A:
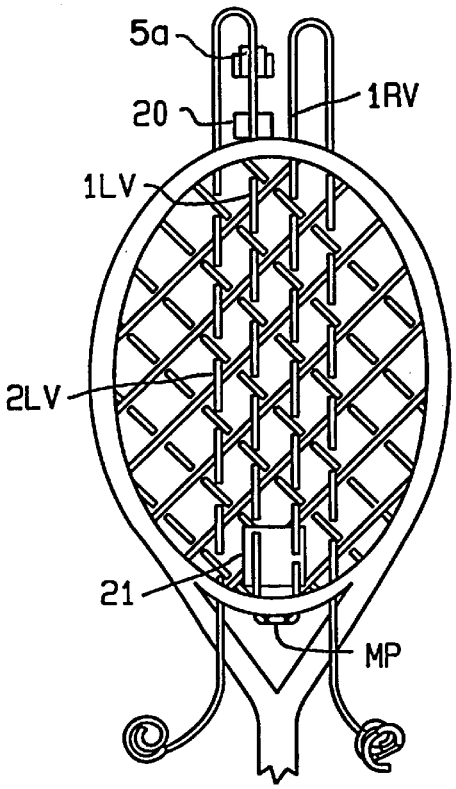
FIG. 3*a* is a view similar to FIG. 3 with vertical stringing continuing.
Figure 3B:
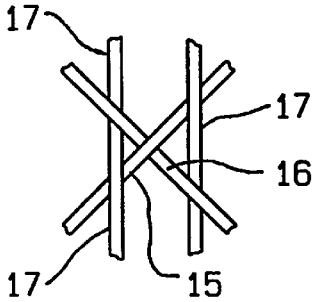
FIG. 3*b* is a partial elevational view showing a string segment weave.

Turning to FIGS. 2, 3, 3*a* and 4, stringing is commenced with left diagonal segments 15 underneath right diagonal segments 16. A string segment is a straight tensioned length of string extending from one inside edge of the frame to another inside frame edge. All left diagonal segments are under all right diagonal segments or vice versa. After stringing the diagonals 15, 16, a group of vertical segments 17 which segments are individually assigned designations 1RV and 1LV (first right and left verticals) on either side of the vertical centerline through head midpoint (MP) are strung using vertical string length 19 (FIG. 3). Verticals may, alternatively, be started at other locations. Further vertical stringing is shown in FIG. 3*a*. Stringing is clamped by starting clamp 20, clamp 21 of the present invention (described in detail below) and machine tensioning arm 5*a*. Vertical segments are woven over the upper diagonals and under the lower diagonals. Turning to FIG. 3*b*, the weave of string segments is seen in which vertical segments 17 are positioned over the upper left diagonal segments 15 and vertical segments 17 are positioned under the lower right diagonal segment 16 and left diagonal segment 15 is over right diagonal segment 16. Stringing is preferably at low to mid tension range.

The method of stringing a racket comprises the steps of alternately stringing and then tensioning substantially both sets of opposing diagonals with conventional or improved tensioning equipment, then interlacing and tensioning the set of vertical strings, using conventional tensioning clamps that accompany stringing machines or clamps of the present invention clamps.

Figure 4:
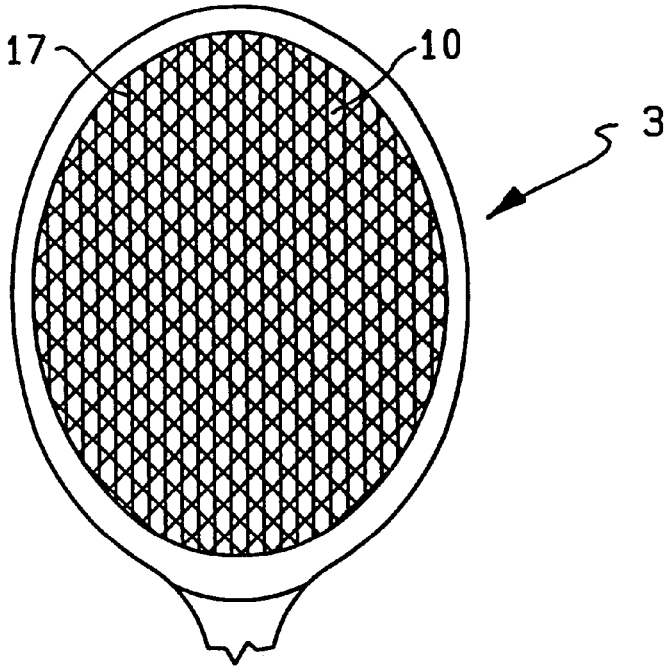
FIG. 4 is a three-string racket strung with diagonals and verticals.
Figure 5:
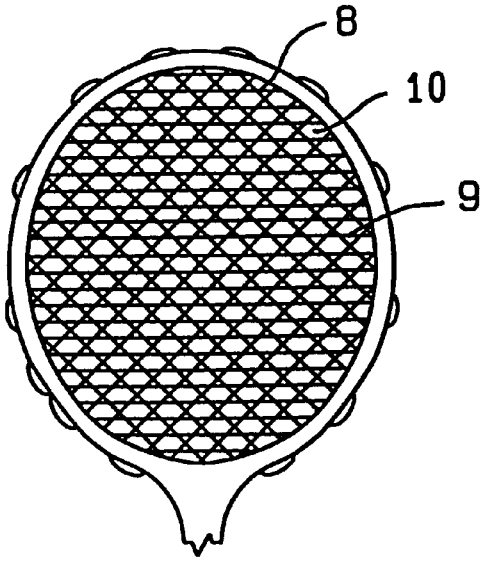
FIG. 5 is a racket strung with diagonals and horizontals.
Figure 6:
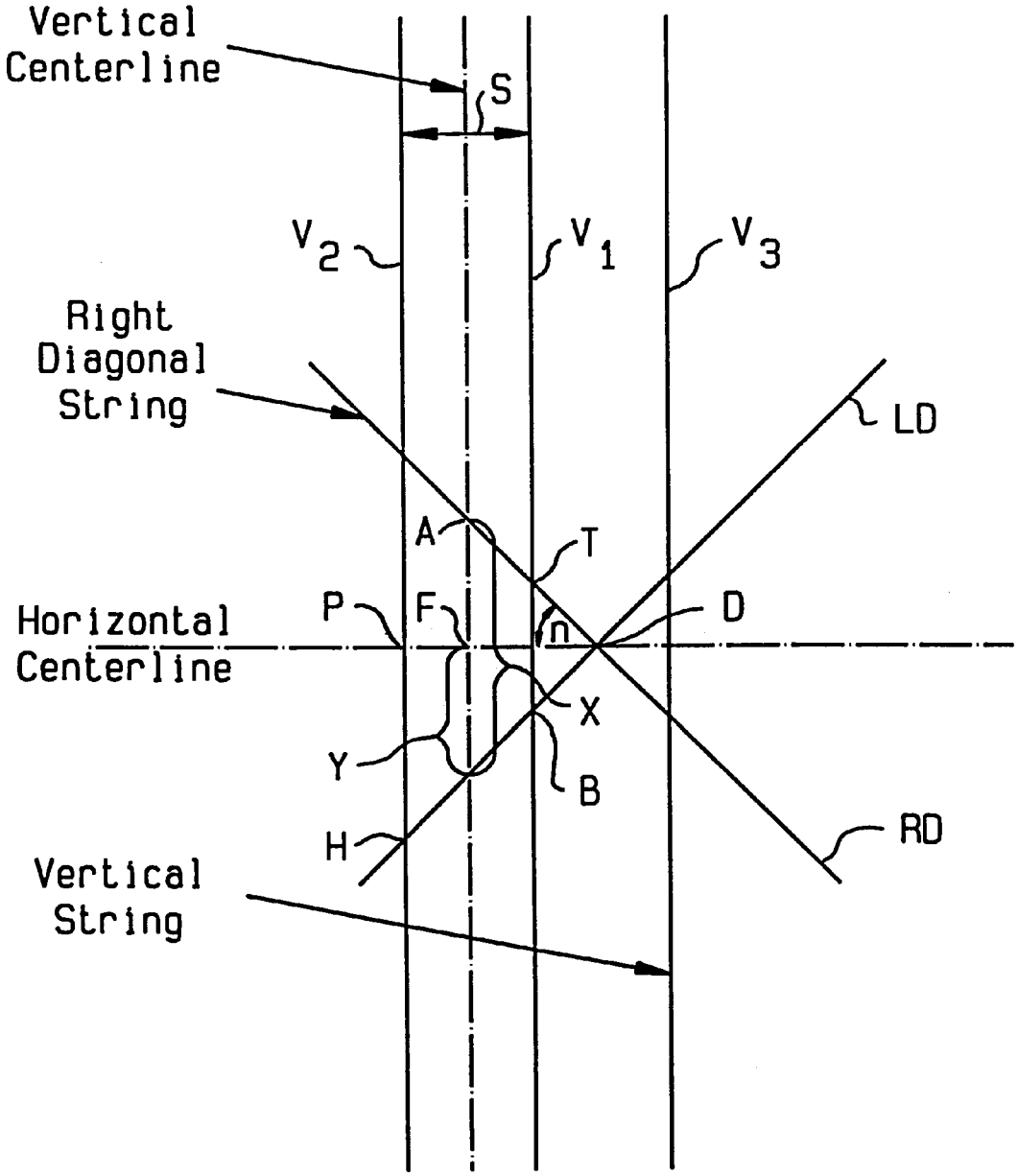
FIG. 6 is a schematic diagram illustrating a procedure for creating a stringing pattern.
Figure 7:
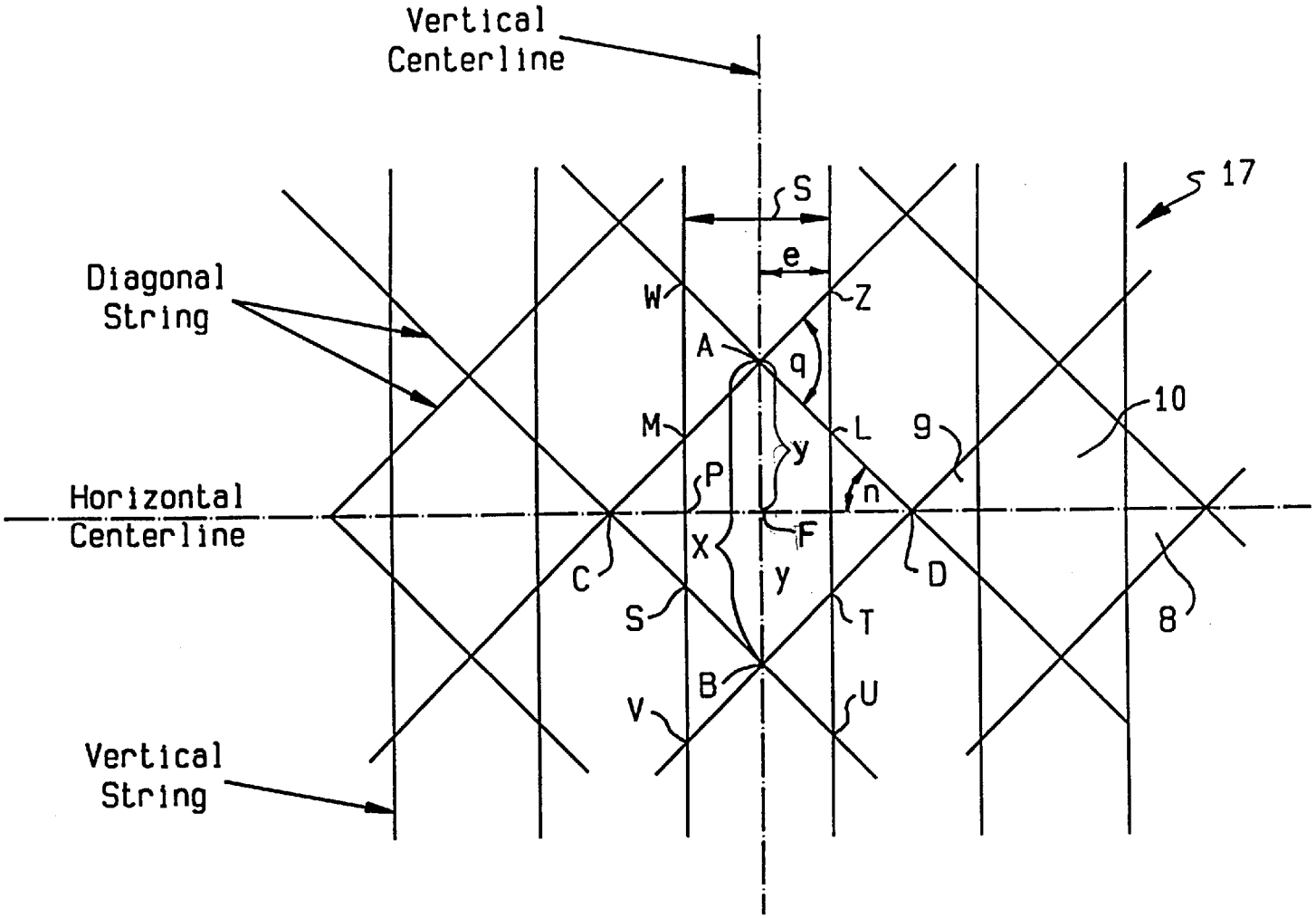
FIG. 7 is a further diagram for computing, calculating and designing a stringing pattern.
Figure 8:
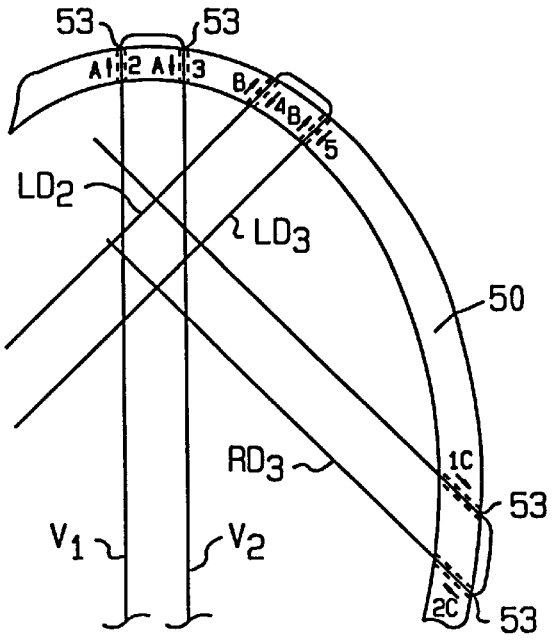
FIG. 8 is a partial plan view of an alternative racket head with indicia to assist in stringing.
Figure 9:
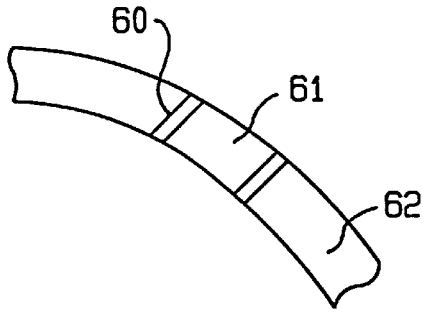
FIG. 9 is a partial sectional view of a further alternative racket head with a string opening including a color coded grommet.
Figure 10:
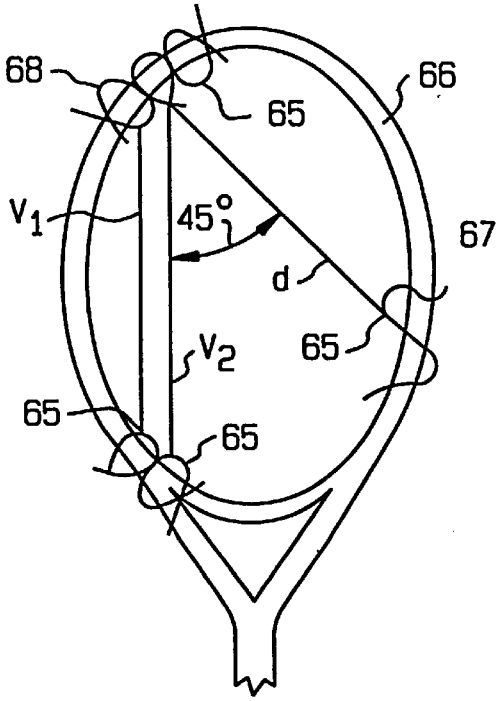
FIG. 10 is a partial elevational view of an alternative racket with loop string holders.

FIG. 4 shows a fully strung racket 3 having vertical segments, and FIG. 5 illustrates a racket head in which horizontal segments are used instead of vertical segments. The stringing patterns of the present invention provide (1) intersection of diagonals at points midway between verticals 17 (i.e. points A and B, FIG. 14), and (2) provide a plurality of hexagonal and triangular openings 8, 9 and 10. Opening 10 is the same size and shape of the area defined by points A, L, T, B, S and M. Openings 8, 9 and 10 vary in size and shape depending on spacing of the string segments and the angles of crossing of the string segments.

A feature of the present invention is to provide a sequence of stringing which is easy to string on conventional stringing equipment with or without use of the above-described clamps depending on the equipment. Where the angles and spacing of the strings are such that conventional clamps do not fit between or among the string segments, the clamps 21, 55 of the present invention may be used. Clamp 21, 55 are sized and shaped at their upper clamping end to permit positioning the clamp in string openings 8, 9 and 10 (FIG. 14).

The present invention overcomes the disadvantages of two directional stringing in which greater vibrations are transmitted to a player's arm, less power is generated, less control is provided and strings break more often. The three-directional racket of the present invention has the advantage that it relieves arm pain, enables excellent control and increases power and spin. The strings in this triaxial stringing design are more securely positioned and move less with less friction of string segments rubbing against one another so that the strings last longer.

With respect to determining a particular three string set pattern in accordance with the present invention, a first method provides the following steps. This method assumes diagonals form a 90° angle with one another where they cross.

Step 1: Locate the vertical and horizontal centerlines of the racket head (see FIG. 13). Using drafting paper trace the unstrung frame hoop and mark the horizontal and vertical centerlines of the hoop;

Step 2: Determine the maximum width of the head from inside the frame side to inside the opposite frame side;

Step 3: Determine the number of vertical strings and the spacing S of the vertical strings (the two center verticals will be ½ S to either side of the vertical centerline) such determinations are made taking into consideration:

(1) the size, shape and type of the frame;

(2) ball size and material;

(3) playability; and (4) compatibility with conventional stringing equipment.

Step 4: Determine the position of left diagonal (LD) by placing point D on the horizontal centerline midway between verticals $V_1$ and $V_3$; Select angle n between 43 and 47° such as 45°; (see FIG. 13).

The tangent of angle n is the opposite side over the adjacent side or AF/FD.

Step 5: Where right diagonal intersects the vertical centerline is point A. Locate the left diagonal (LD) by placing it through point D perpendicular to RD. LD intersects the vertical at point H. Diagonal RD intersects vertical $V_1$ at point T.

Having located vertical string spacing as distance S the spacing between points A and B as distance X and angle n as an angle between 43° and 47° or other ranges set out above, further verticals and horizontal strings are added to form the pattern of FIGS. 4 or 5.

Angle n determines the degree of verticality of the diagonals of the stringing pattern of the present invention. In this pattern, changing the angle n of the diagonals forces a change in the distance S between verticals segments and also changes the spacing between intersecting diagonals. The greater the degree of angle n the steeper is the angle of the diagonals.

The above steps for determining the location of strings employs tracing paper and a writing instrument or other mechanical arrangement. Once a complete stringing pattern is determined, holes are drilled in the racket head.

A second method for determining a string pattern is more complex since it does not assume the diagonals cross at 90° angles. In this method determining the angle at which diagonals cross is influenced by the factors listed above (see FIG. 14). This second process is implemented by using mathematical calculations.

With respect to the following formulas:

Formula #1: Tan n=y/s

Formula #2: x=2y

Let S=spacing between verticals: S=PT=FD e=PF=FT=TD; 2e=S

Let X=spacing between the intersection of diagonals: x=AB, AF=Y FB=y; y=x/2

In using the above formulae, calculate a convenient measurement for y and x based on the selected angle n. Angle q is in the ranges of 70°–110° or 80°–100° or 86°–94°.

First solve for y in Formula #1, then solve for y using Formula #2. With respect to Formula #1, keep two variables constant and solve for the third variable, repeatedly doing so until an acceptable pattern is derived. Compute iterations of Formulas #1 and #2 until (1) a satisfactory angle n is found;

(2) the optimum spacing S between strings is derived; and (3) an optimum number of vertical and diagonals are found.

EXAMPLE 1

Referring to the diagram of FIG. 14, and formulas below, once the three measurements of angle n, and the spacing of lengths s and x are derived, draw on suitable paper, verticals on either side of the horizontal midline, spaced e inches apart then draw the rest of the verticals S distance apart. Then mark off the spacing of the intersecting diagonals on the vertical midline between the central two verticals. Finally, draw in the diagonals, intersecting each other on points on the vertical midline marked x inches apart, such that the intersecting diagonals cross each other at an angle of q degrees.

Diagram 1

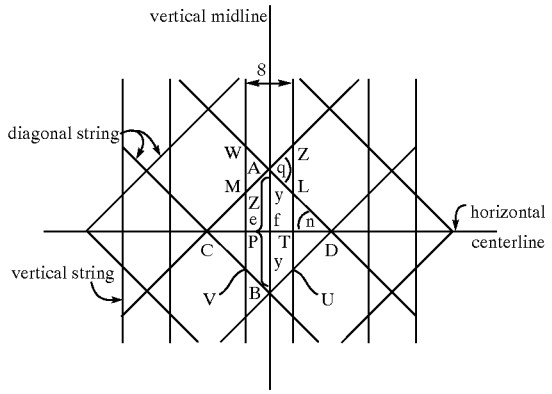

The degree measurement of angle n determines the degree of verticality of the diagonals of a three-directional vertical-diagonal pattern. In this symmetric pattern, changing the angle of the diagonals forces a change in the spaces between the vertical segments, and also changes the spacing between the intersecting diagonals. The greater the degree measurement of angle n, the more vertical (steeper) in orientation the angle of the diagonals will be. Formula #1 shows the mathematical (trigonometric) relationship between the angle of the diagonals, the spacing between the verticals, and the spacing between the intersecting diagonals of this three-directional pattern. In the diagram above:

(∠=Angle) ∠ZAL=q ∠LDT=∠n ∠q=2n; q/2=n ZU // WV; ZC // DV; WD//CU

The vertical centerline, AS, is the perpendicular bisector of PT through point F such that point F is midway between the two verticals; ZU and WV.

Let s=spacing between the verticals: s=PT=FD; e=PF=FT=TD: 2e=s

Let x=spacing between the intersecting diagonal strings: x=AB; AF=FB=y; y=x/2

Find the Tangent of Angle n, in Right Triangle DAF

Formula #1: Tan n=y/s; expressed another way. Tan Angle n=AF/FD

STEP 1: To drafting paper, firmly secure racket symmetrically about central vertical and horizontal centerlines. Trace the unstrung frame hoop on a piece of graph paper, or other type of paper, and mark the curved inner centerline of the hoop. Trace the exact frame geometry, and measure the lengths of the horizontal and vertical centerline.

STEP 2: As defined in the Formula #1 and the diagram above, choose a convenient n and s, optimally n should be approximately 45 degrees. The greater the value of angle n, the steeper the angle of the diagonals. To derive the value of S, count the number of vertical strings desired, as a starting number to set the patten, then divide the horizontal centerline length by that number. Or, choose an s, and then divide the horizontal centerline by that number to determine the number of verticals that the patten will have.

STEP 3: Calculate a convenient measurement for y and x, based on the angle that the diagonals cross each other being approximately 45. If an angle less than that is chosen with diagonals first method it may not be able to be strung on most stringing machines which hold the racket in two-points, they must be strung on a stringing machine that holds the racket in more than two places. Then, calculate the corresponding spacing between the intersecting diagonals based on a fixed diagonal angle n and fixed spacing s between the verticals.

To do this, in Formula #1, first solve for y.

Formula #1 Tan n=y/s

STEP 4: Next, in Formula #2, solve for x, the spacing between the intersection of diagonal strings.

Formula #2 x=2y

If different spacing is desired, either to put more or less diagonals or verticals in the pattern, or to increase or decrease the verticality of the diagonal angle, keep two less constant in Formula #1 and solve for the third variable, repeatedly doing so until an acceptable patten is derived. It may be necessary to set angle n greater than or equal to 45 degrees, which would cause the value of the tangent to be greater than or equal to 1. This will insure that there is sufficient verticality in the pattern to offset the horizontal components of the diagonal strings. Continue computing iterations of Formula #1 and #2 until a satisfactory angle, the optimum spacing between the strings is derived, and thus a pattern for the racket that has an optimum number of vertical and diagonals strings. For most frames not to warp, the degree of angle n must be around 45° or greater, so that the angle is equal to or more vertical in direction than horizontal. If the angle is 45° the horizontality will equal the verticality. This is optimum. When calculating the tangent of an angle, the side opposite the angle (the vertical component) becomes the numerator, and the side adjacent to the angle (the horizontal component) becomes the denominator. If the vertical segment is greater than or equal to the horizontal segment, then the angle of the diagonal will not be more horizontal than vertical, thus preserving the structural stability of the frame against too many horizontal forces when the diagonal string segments are tensioned first. After a given spacing for the verticals has been selected, draw in the verticals, and measure the 3rd vertical from the center, on either side. Measure the length of it, and divide that length by the value of 'y'. There are formulas to determine the number of diagonals any racket will have based on a given 'y' length. These formulas are different for each respective racquet sport. It is possible then to predict the number of diagonals in a given pattern, and perform iterations to arrive upon an exact desired number, adjusting the width between verticals, angle of the diagonals and spacing between the intersecting diagonals, until the optimum pattern is derived.

To a large extent, the size of the ball for a given sport and the size and shape of the rackets used for that sport determines the range of the spacing between the strings. There are many possibilities for the number of strings in each direction. The spacing between the diagonal segments evidenced by the triangles on a particular string length vary from sport to racket sport, and from frame to frame, based on each frame geometry and desired density of the string pattern. Reference is made herein to teach how the calculations for one particular tennis racket pattern was calculated. For squash, racquetball and badminton, which use different types of balls which inherently require different density of strings than tennis rackets, other formulas derive the relationship between the number of diagonals and the number of triangular segments necessary for a given string length.

Using a midsize tennis racket frame as an example, first plot the verticals, then measure the length of the 3rd vertical from the center, calling it GH. Using GH, we will determine the number of triangular segments (J) that will occur in the pattern. Dividing GH by y, computes the value of J.

Let J=the number of triangular segments occurring on the 3rd vertical from the center. Let k=the number of diagonals in each diagonal direction in a given tennis racket pattern, then Formula #3 2K−5=J. calculates the number of diagonals based on a certain number of triangular string segments.

STEP 5: Divide "s" by 2, to get "e", such that 2e=s.

STEP 6: On the horizontal centerline, mark off a distance the length of "e" on either side of center vertical line, marking them P and T, respectively.

STEP 7: Starting from points P and T, measure out and mark verticals such that they are "s" measures of length apart, across entire horizontal centerline.

STEP 8: On the vertical centerline, mark off a distance the length of the length of "y" on either side of center vertical line, marking them A and B respectively.

STEP 9: Starting from points A and B, either measure out and mark points such that they are Y measures of length apart, across entire vertical centerline or start the markings, "x" distance apart at the top or bottom of the frame, and mark "x" units on the vertical centerline.

STEP 10: Draw in the diagonals in both directions, by setting a triangle drawing device to angle n. Using a horizontal line as a guide, draw in the diagonals so that they intersect the vertical centerline on markings "x" units apart.

STEP 11: The point where the strings of the pattern intersect the curved inner centerline of the hoop determines the placement of the string support means. Once a pattern is established it may be necessary to make a few iterations of the pattern to arrive at the optimum angle for the diagonals that is harmonious with the proper number of diagonal and vertical strings, and is spaced conveniently around the frame geometry.

Turning to a further embodiment and FIGS. 15 and 16, frame 50 has string-receiving openings 53 which are color coded. In addition, openings 53 may have identifications or designations of string directions located, at or near openings 53. The three sets of strings, may for example, be color coded as follows:

| | Code | | |
|---|---|---|---|
| | Color | and | Letter |
| Verticals | Red | | A |
| Left Diagonals | Blue | | B |
| Right Diagonals | Green | | C |

Figure 11:
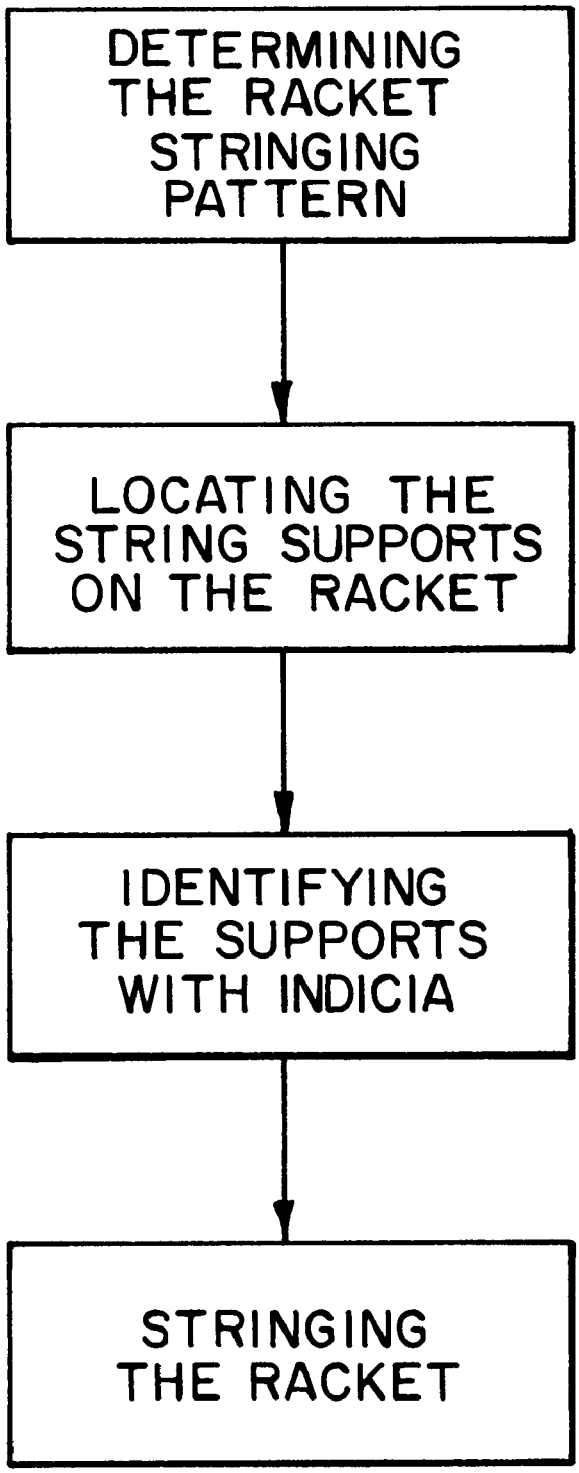
FIG. 11 is a flowchart showing a stringing method using indicia markings.

In stringing racket frame 50, diagonals are strung first. For example, left diagonal LD2 is threaded through frame opening marked "4" and "B". The letter "B" or adjacent area is blue. Directional arrows assist the stringer. LD strings are blue and B may be blue or stand for blue. Similarly, vertical string $V_1$ is later threaded through an opening marked "2" and "A" and having a directional arrow adjacent the "A". Sequential numbering of openings 53 may be used to instruct the stringer as to the order of string segment formation. Decals may be adhered to the racket frame used. RD stringing is color coded green (See FIG. 11).

In stringing the racket, the diagonal string segments may comprise one long piece of string or two separate strings. The vertical (or horizontal) string segments may be formed of a single length of string or it may all be done with one length. All or portions of the string length may be colored to indicate left diagonal, right diagonal, vertical, horizontal segment used or the center of string length. Any string for a racket can be marked at selected intervals along its length by color or otherwise. Half of a string may be one color and half another color. The center of a string length may be marked by color or otherwise to facilitate finding the center and then using one-half to string one set of diagonals and using the other half to string the other diagonals.

Turning to FIG. 16, a further embodiment is shown in a color coded grommet 60 positioned in racket hole 61 of racket frame 62.

Turning finally to FIG. 17, loop string supports 65 are shown on racket 66. Loops 65 are created by weaving a relatively stiff plastic string 67 in one direction and a further plastic string 68 in the other direction to create adjacent string support 65. Two vertical segments $V_1$ and $V_2$ and one diagonal d are shown threaded through loops 65.

To prevent distortion of the racket frame during stringing, a number of tensioned vertical segments, or other means, are positioned before the diagonals are strung. When diagonals are completed, they can be removed, if necessary, to complete weaving the set of main strings, woven through the diagonals.

The present invention is useful for all types of rackets used in the sports of tennis, racquetball squash and badminton.

We claim:

1. A method of stringing a game racket comprising (a) determining the stringing pattern;

(b) locating the string supports on the racket;

(c) identifying the supports with indicia to assist in stringing; and (d) stringing the racket using string lengths having identifications which relate to the support identifications.

2. The racket made by the practice of claim 1.

* * * * *